US006048074A

United States Patent [19]

Wang

[11] Patent Number: 6,048,074

[45] Date of Patent: Apr. 11, 2000

[54] MINIATURE LAMP ASSEMBLY HAVING EXTERNAL INTERLOCKING DEVICE

[75] Inventor: Jessica Wang, Taipei, Taiwan

[73] Assignee: Toyo Electric Mfg. Co. Ltd., Taipei, Taiwan

[21] Appl. No.: 09/063,709

[22] Filed: Apr. 21, 1998

[51] Int. Cl.[7] ..... H01R 33/00

[52] U.S. Cl. ..... 362/226; 362/806

[58] Field of Search ..... 362/226, 227, 362/249, 238, 382; 439/617, 616

[56] References Cited

U.S. PATENT DOCUMENTS

| | | | |
|---|---|---|---|
| 4,319,797 | 3/1982 | Otani | 439/358 |
| 4,801,275 | 1/1989 | Ikeda | 439/357 |
| 4,943,899 | 7/1990 | Tseng | 362/226 |
| 4,970,632 | 11/1990 | Tseng | 182/82 |
| 5,001,615 | 3/1991 | Stefanelli | 439/611 |
| 5,012,397 | 4/1991 | Tseng | 362/457 |
| 5,278,741 | 1/1994 | Ehrman | 362/249 |
| 5,367,443 | 11/1994 | Hara | 362/249 |
| 5,428,516 | 6/1995 | Harris | 362/238 |
| 5,481,444 | 1/1996 | Schultz | 362/391 |
| 5,580,159 | 12/1996 | Liu | 362/249 |
| 5,647,759 | 7/1997 | Lien | 439/356 |

*Primary Examiner*—Sandra O'Shea
*Assistant Examiner*—Hargobind Sawhney
*Attorney, Agent, or Firm*—Martin Smolowitz

[57] ABSTRACT

A miniature decorative electric lamp assembly includes an electric bulb inserted into a lampbase member, with the lampbase lower end being received in the upper end of a central longitudinal passageway in a socket member which contains dual electrical contacts each connected to an insulated wire. The lamp assembly also includes an external interlocking device for which the lampbase upper portion includes an elongated semi-flexible radial extending tongue element which has an outer biased elastic detent portion, and the socket member includes a rigid radial frame element having a central opening. During lamp assembly the lampbase member is inserted into the socket member and the internal electric contacts are made and the tongue detent portion is hooked into the frame element, so that the two members are locked firmly together so as to preclude any inadvertent separation and electric disconnect during handling or use.

14 Claims, 2 Drawing Sheets

FIG. 1
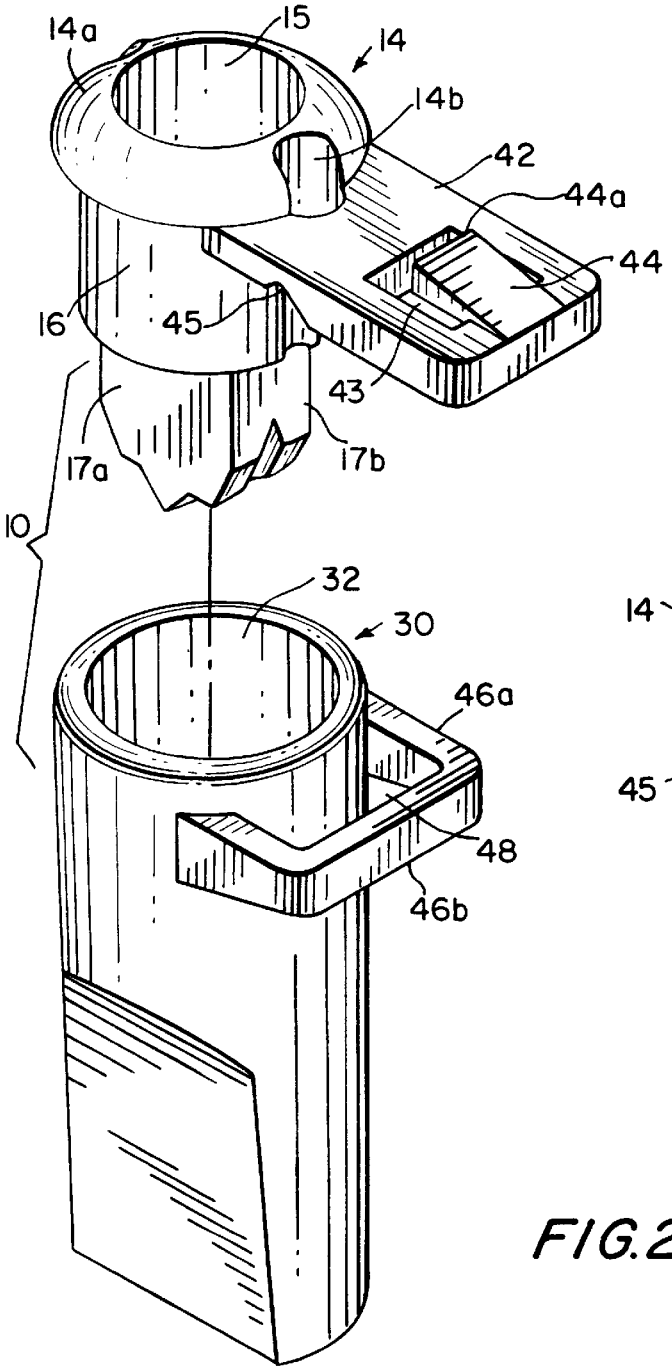
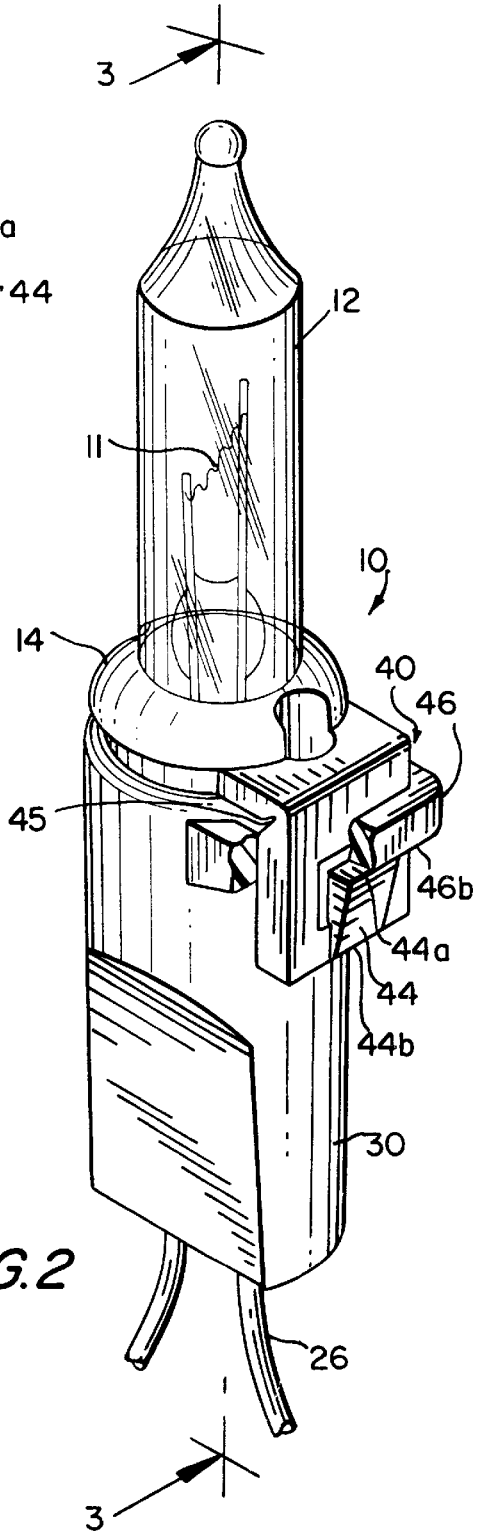
FIG. 2

MINIATURE LAMP ASSEMBLY HAVING EXTERNAL INTERLOCKING DEVICE

BACKGROUND OF INVENTION

This invention pertains to miniature electric lamp assemblies utilizing an improved external interlocking device. It pertains particularly to such lamp assemblies in which a lampbase member is automatically and reliably attached to a socket member by the external interlocking device utilizing a biased elastic detent.

Miniature electric lamp assemblies having various configurations have been produced and used in lamp strings for many years. However, a common problem associated with such lamp assemblies which are electrically connected together in a series arrangement is that whenever parts of an individual lamp assembly may become detached such as during handling or use, the entire lamp string fails. Various interlocking configurations and devices have been developed to prevent such electrical disconnects between the members of a lamp assembly. Examples of known miniature lamp assemblies having such interlocks include U.S. Pat. No. 5,001,615 to Stefanelli which discloses a lamp assembly having an external positive interlock structure for the lampbase and socket members which requires an undesirable second separate motion at assembly to effect an interlocking action. U.S. Pat. No. 5,278,741 to Ehrman discloses a similar conventional lamp assembly but which utilizes an internal locking configuration in which a resilient element of a lampbase member is engaged in a wall opening in a socket member. U.S. Pat. No. 5,367,443 to Hara discloses a lamp assembly in which an upper lampbase member is attached into a socket member by an external flexible finger having an opening which during assembly can be hooked over a rigid lug element of the socket member. Also, U.S. Pat. No. 5,428,516 to Harris discloses an interlock for miniature lamp assemblies in which an upper lampbase member is interlocked into a lower socket member by an L-shaped tongue element having an aperture which is hooked over a rigid lug projecting outwardly from the socket member. However, these known miniature electric lamp assemblies all have various deficiencies in their interlocking configurations and actions. Because of these deficiencies in the known miniature decorative lamp assemblies, further improvements for providing safer and more reliable miniature lamp assemblies have been sought.

SUMMARY OF INVENTION

This invention provides a miniature decorative electrical lamp assembly including a bulb having dual bare wires extending from its lower end, with the bulb being inserted into an upper cavity of a lampbase member. The lampbase member is received in the upper portion of a longitudinal central passageway in a socket member which has dual electrical insulated wires extending from its lower end, so that during the lamp assembly step the bulb dual bare wires are each electrically connected to one of the insulated wires. The lampbase member lower portion is sized to be inserted snugly into the upper passageway in the socket member, so that the lampbase lower end occupies a space between upper ends of the dual electrical insulated wires. The lampbase member is conveniently and reliably interlocked into the lower socket member during lamp assembly by an improved external interlocking device, which includes two interfitting elements which are easily connected together during the lamp assembly step so as to prevent accidental or unintended separation of the lampbase and socket members of the lamp assembly.

The external interlocking device elements include: (a) an upper elongated semi-flexible tongue element attached integrally to the upper portion of the lampbase member, and extending first radially outwardly then is bent downwardly at about 90° angle so as to be generally parallel with the lampbase member wall, and including a central slotted opening having a biased elastic detent portion providing at the tongue outer end; and (b) an integral rigid frame element projecting radially outwardly from the lower socket member upper rim portion, the frame element having a central opening which is preferably rectangular-shaped and sized for receiving the downwardly-bent portion and biased detent of the upper tongue element (a). The interlocking device is configured so that during assembly of the lampbase member into the socket member, the device upper tongue element is inserted into the central opening of the lower radially projecting rigid frame element, so that the tongue element biased elastic detent portion engages with an outer wall portion of the frame element central opening. Such engagement of the upper tongue element and its biased detent portion into the central opening of the rigid frame element effectively provides an interlocking action with the frame element which prevents any undesired separation of the lampbase and socket members.

For miniature electric lamp assemblies constructed according to this invention, the improved external interlocking device advantageously locks the lampbase member with its electric bulb and dual bare wires into the socket member, and effectively prevents any accidental or unintended separation. Such separation would usually cause an electrical disconnect in the lamp assembly and failure of an entire string of multiple series-connected lamp assemblies. The lampbase and socket members and the interlocking device are suitably formed of a moldable semi-rigid plastic material, such as polyethylene, polypropylene, or similar materials.

DESCRIPTION OF DRAWINGS

This invention will be described further with reference to the following drawings, in which:

FIG. 1 shows an elevational exploded view of a miniature electrical lamp assembly, including lampbase and socket members with the assembly having an external interlocking device for retaining the members together;

FIG. 2 shows a perspective view of a miniature lamp assembly according to this invention, including an electric bulb inserted into the lampbase member which is received in and interlocked onto the socket member;

DESCRIPTION OF INVENTION

Figure 3:
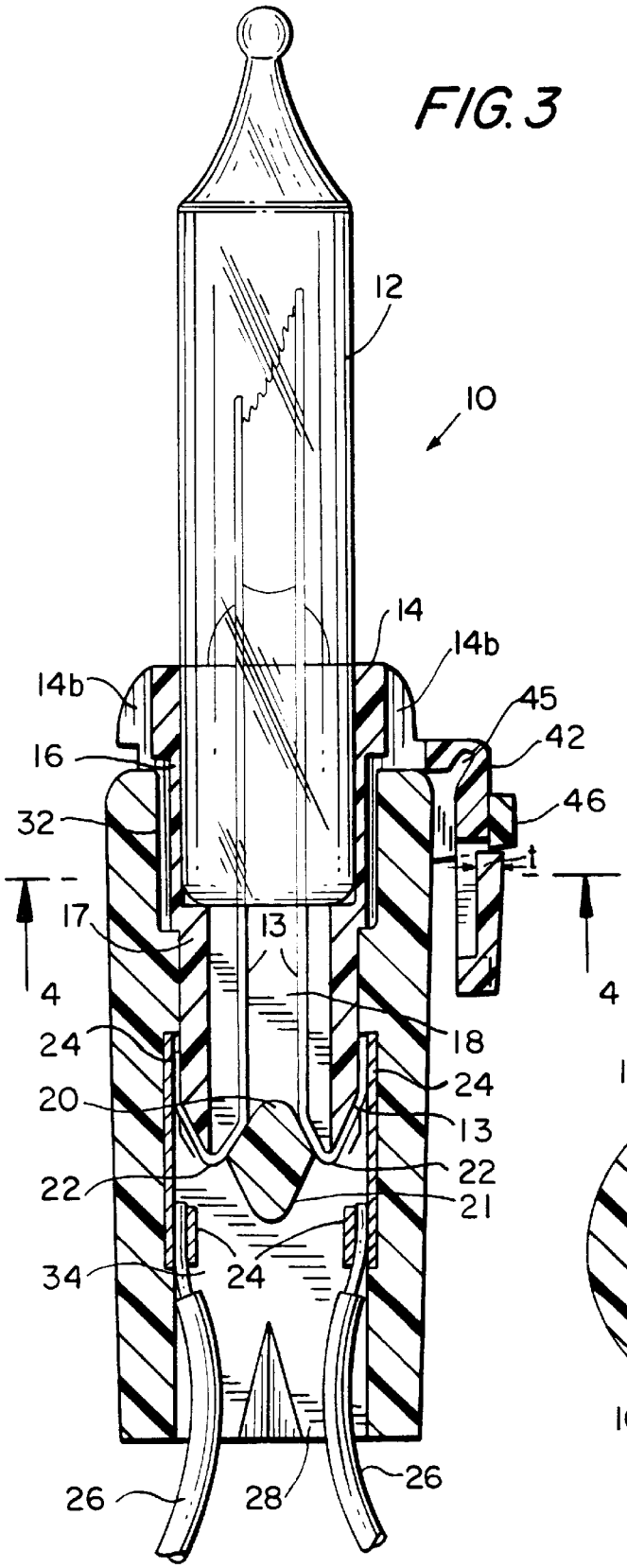
FIG. 3 shows an elevation sectional view of the lamp assembly taken at line 3—3 of FIG. 2.

As shown by FIGS. 1–4, a miniature decorative electrical lamp assembly 10 includes a bulb 12 having an inner filament 11 and dual bare electrical lead wires 13, with the bulb and bare wires being inserted snugly into a lampbase member 14. The lampbase 14 has an outer flange 14*a* and a central cavity 15 provided at the lampbase upper end, and into which cavity the bulb 12 is inserted. The lower portion of lampbase member 14 is received into the upper end of a central longitudinal passageway of a holder socket member 30, which includes dual insulated electric wires 26 extending from its lower end and which has a central lower opening 28. The upper lampbase member 14 is reliably retained into the lower socket member 30 by a relatively tight frictional fit of the complementally shaped parts, and the members are additionally retained together by an external interlocking device 40, which will be described further hereinbelow.

As best shown by FIGS. 1 and 3, the lampbase member 14 has a cylindrical-shaped upper portion 16 surrounding the central upper cavity 15, and includes a central lower extension portion 17 having two flat opposite wide sides 17*a* and two opposite narrow sides 17*b*. The lampbase member 14 has a central lower inner passage 18 provided within the extension portion 17. The lower inner channel passage 18 is rectangular-shaped in cross-section and has a central divider portion 20 and dual openings 22 provided adjacent the dual opposite narrow sides 17*b* for receiving the dual bare wires 13 from bulb 12 which pass through the lampbase dual openings 22. The central divider 20 includes a lower triangular-shaped projection 21 which preferably extends below the dual openings 22 by a length equal to 20–40% of the length of the lampbase flat-sided lower extension portion 17*a*. The lampbase upper flange 14*a* and cylindrical portion 16 have dual opposite vertical grooves 14*b*, and the rectangular-shaped inner channel 18 has the central projection 20 located between the dual openings 22.

As best shown by FIG. 3, the lampbase member 14 has its upper portion 16 inserted into the upper portion 32 of a central cylindrical-shaped passageway 34 provided in the holder socket member 30, with the dual bare lead wires 13 of the bulb 12 extended downwardly through the dual openings 22 provided in the lower end of the lampbase extension portion 17. The bare wires 13 are separated by the central divider 20 and are each bent upwardly against the vertical narrow side surface 17*b* of the lampbase. The bare wires 13 are each maintained in electrical contact with a metal blade contactor 24, which are each connected to the bare end of one of the dual insulated wires 26 and inserted into the lower portion of the central passageway provided in the lampholder socket member 30.

Figure 4:
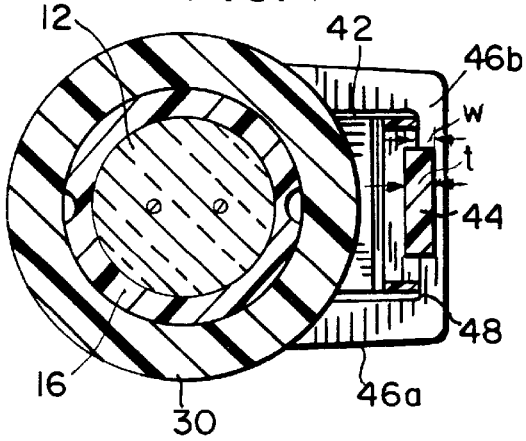
FIG. 4 shows a cross-sectional view taken at line 4—4 of FIG. 3.

As also shown by FIGS. 1–4, the lampbase member 14 of lamp assembly 10 is firmly attached into the holder socket member 30 by the external interlocking device 40. The interlocking device includes an upper elongated integral semi-flexible tongue element 42 which extends radially outwardly from the lampbase 14 cylindrical portion 16, and is preferably located in alignment with one of the lampbase narrow sides 17*b*, and encloses one of the vertical grooves 14*b*. The tongue element 42 includes a central slot 43, which has a biased elastic detent portion 44 provided at the tongue element outer end. The detent 44 has an upper edge 44*a* and includes a lower biased hinge portion 44*b* by which the detent is attached to the tongue 42. Also, the detent 44 upper edge 44*a* has a thickness "t" which is equal to 50–100% of that of tongue 42, and is formed so that the upper edge 44*a* in normally biased to extend outwardly from the outer surface of the tongue element 42 by a distance "w", which is equal to at least about 50% of the detent thickness "t", as is best shown in FIGS. 3 and 4.

An integral rigid frame element 46 extends radially outwardly from near the upper end of socket member 30, and includes dual radial legs 46*a* attached to a transverse bar 46*b*, and includes a central opening 48, which is preferably rectangular-shaped. The central opening 48 of the radial frame element 46 is sized to receive the outer end portion of the tongue element 42. As shown by FIGS. 2–4, during assembly of the lampbase 14 with bulb 12 into the lower socket member 30, the tongue element 42 is folded downwardly at its resilient hinge line 45 at about 90° angle and inserted into the central opening 48 of the rigid frame element 46. The biased elastic detent portion 44 of the tongue element 42 is so located that whenever the lampbase member 14 is fully inserted into the socket member 30, these members are reliably retained together by the upper edge 44*a* of the biased resilient detent 44 being engaged with the lower surface of outer bar portion 46*b* of the frame element 46. It is emphasized that for this external locking device 40 to be reliably operational, the detent lower hinge portion 44*b* in combination with the tongue upper hinge 45 together must provide a sufficient outward bias force and resiliency so that the detent upper edge 44*a* remains hooked below the lower surface of the outer transverse bar 46*b* of the rigid frame 46, except whenever the detent may be intentionally manually pressed inwardly and released.

It is seen that for this miniature lamp assembly 10 having an improved external interlocking device 40 according to this invention, when the lampbase member 14 lower extension 17 is inserted into socket member 30 to a location between the dual metal contacts 24 and also between upper ends of the dual insulated wires 26, the outer end of the tongue element 42 is also conveniently bent at the biased resilient hinge 45 and inserted into the central opening 48 of the rigid frame element 46, so that the biased detent 44 is locked within the opening 48. By this arrangement, it is apparent that a firm and reliable interlock between the lampbase and holder socket members is made, and any inadvertent separation and electrical disconnect between the dual bare wires 13 and dual connectors 24 is effectively prevented. Whenever it is desired to separate the lampbase 14 and socket member 30, the biased detent 44 is first manually pressed inwardly sufficiently to clear the frame outer bar portion 46*b*, after which the two members can be manually separated from each other.

This invention will be described further by the following Example, which should not be construed as limiting the scope of the invention.

EXAMPLE

A miniature decorative electrical lamp assembly is provided including a cylindrical-shaped electrical bulb having an internal filament and dual bare wires extending downward from the bulb lower end. The bulb and its dual bare wires are inserted into a central cylindrical-shaped upper cavity of a lampbase member, so that the bare wires extend first through dual openings provided in the lampbase lower end extension and then each wire extends upwardly along the lampbase extension narrow outer surface. The lampbase member is received in the upper portion of a central passageway in a holder socket member having dual insulated wires entering from its lower end, with each insulated wire being attached to a metal conductor plate which is placed in electrical contact one of the two bare wires from the bulb. The lamp assembly includes an external interlocking device in which a semi-flexible tongue element which initially extends radially outwardly is folded downwardly during a lamp assembly step and enters a central opening in a rigid frame element attached integrally to a side of the socket member. The tongue element includes a biased elastic detent portion the upper edge of which is retained by an outer bar portion of the rigid frame element, so that the lampbase and socket members are attached firmly together and any inadvertent separation and consequential internal electrical disconnects are prevented.

Typical important dimensions for the miniature electrical lamp assembly of this invention are as follows:

| | |
|---|---|
| Bulb diameter, mm | 5.3 |
| Lampbase overall length, mm | 13 |
| Lampbase upper cavity dia., mm | 5.4 |
| Lampbase upper cavity depth, mm | 6.0 |
| Lampbase cylindrical portion dia., mm | 7.0 |
| Lampbase lower portion length, mm | 5.2 |
| Lampbase lower projection length, mm | 1.5 |
| Socket member length, mm | 16 |
| Socket upper passageway dia., mm | 7.1 |
| Tongue element length, mm | 7.6 |
| Tongue element width, mm | 5.4 |
| Tongue detent width, mm | 3.3 |
| Detent upper edge thickness, mm | 1.0 |
| Rigid frame opening width, mm | 5.5 |

For the external interlocking device of this invention, it is seen that because the tongue detent portion upper edge having thickness of about 1.0 mm is lodged beneath the outer bar portion of the rigid frame element, any undesired separation of the lampbase member from the socket member is effectively prevented.

Although this invention has been described broadly and in terms of a preferred embodiment, it will be understood that modifications and variations can be made all within the scope as defined by the following claims.

What is claimed is:

1. A miniature electric lamp assembly having an external integral interlocking device, comprising:

a lampbase member having a cylindrical-shaped upper portion surrounding a central cylindrical-shaped upper cavity, said lampbase member having a lower portion with an inner channel having dual spaced-apart openings provided at the channel lower end; said lampbase member having an elongated semi-flexible tongue element extending radially outwardly from its upper portion, said tongue element including a biased elastic detent portion provided at the tongue element outer end;

an electrical bulb having dual bare wires extending from the bulb lower end, said bulb being received in the lampbase member central upper cavity with each said bare wire outer end being inserted through one of the dual openings in the lampbase lower end; and a holder socket member having a central passageway upper portion shaped for receiving said lampbase member, said holder socket member containing dual electrical metal contactors each connected to an insulated wire extending from the socket member lower end, said socket member having an integral rigid frame element extending radially outwardly, said frame element having a central opening; whereby the lampbase member lower portion is inserted into the socket member central passageway so that the bulb dual bare wires are each in electrical contact with one of the dual electrical contactors and the elongated semi-flexible tongue element is being and automatically inserted into said rigid frame element central opening, so that the tongue element biased elastic detent portion is engaged firmly within the rigid frame element central opening so as to prevent inadvertent separation of the lampbase and socket members.

2. The lamp assembly of claim 1, wherein said lampbase member elongated tongue element includes a biased elastic hinge portion located near the lampbase member.

3. The lamp assembly of claim 1, wherein said tongue element biased elastic detent portion has a rectangular shape.

4. The lamp assembly of claim 1, wherein said socket member rigid frame element central opening is rectangular-shaped.

5. The lamp assembly of claim 3, wherein the biased elastic detent portion upper surface contacts a lower surface of the rigid frame element.

6. The lamp assembly of claim 1, wherein said elongated tongue element is located in alignment with a narrow side of said lampbase member lower extension portion.

7. The lamp assembly of claim 1, wherein said biased elastic detent portion has an upper surface which is biased outwardly sufficiently to engage an outer bar portion of said rigid frame element.

8. The lamp assembly of claim 7, wherein said biased elastic detent portion upper surface normally extends outwardly from the tongue element outer surface by a distance equal to at least 50% of the detent portion thickness.

9. A miniature electric lamp assembly having an integral external interlocking device, the lamp assembly comprising:

a lampbase member having a cylindrical-shaped upper portion surrounding a central cylindrical-shaped upper cavity, said lampbase member having an elongated lower portion with flat sides and an inner channel having dual spaced apart openings provided at the channel lower end; said lampbase member having an elongated semi-flexible tongue element including an elastic hinge-portion and a rectangular-shaped biased elastic detent portion provided at the tongue element outer end;

an electric bulb having dual bare wires extending from the bulb lower end;

said bulb being received in the lampbase member central upper cavity and with the bare wire outer ends each being inserted through one of the dual openings in the lampbase channel lower end;

a holder socket member having a central longitudinal passageway with an upper portion shaped for receiving the lampbase upper portion and a lower passage shaped for receiving said lampbase lower extension portion, said socket member containing dual electrical metal contact plates each connected to an insulated wire extending from the socket member lower end, said socket member having an integral rigid frame element extending radially outwardly from the socket member upper portion, said frame element having a central rectangular-shaped opening; whereby the lampbase member lower portion is inserted into the holder socket member central upper passageway so that the bulb dual bare wires are each arranged in electrical contact with one of the dual electrical contact plates; and the elongated semi-flexible tongue element is bent downwardly and automatically inserted into the rectangular-shaped opening in the rigid integral frame element so that the biased elastic detent portion is engaged firmly within the rigid frame element central opening so as to prevent inadvertent separation of the lampbase and socket members.

10. In a miniature electrical lamp assembly, including:

a lampbase member having a cylindrical-shaped upper portion surrounding a central cylindrical-shaped upper cavity, the lampbase member having a lower portion with an inner channel having dual spaced-apart openings provided at its lower end; the lampbase member having an electrical bulb with dual bare wires extending from the bulb lower end, the bulb being received in the lampbase member central upper cavity with the bare wires outer ends each being inserted through one of the dual openings in the lampbase lower end; and a socket member having a central upper passageway shaped for receiving the lampbase upper portion and a lower passage shaped for receiving the lampbase lower extension portion, said socket member containing dual electrical metal contactors each connected to one electrical insulated wire extending from the socket member lower end, the improvement wherein:

an elongated semi-flexible tongue element extends outwardly from the lampbase upper portion, said tongue element including a biased elastic detent portion provided at the tongue outer end; and an integral rigid frame element extending radially outwardly from said socket member upper end; said frame element having a central opening sized for receiving the tongue element therein, whereby the lampbase member lower end portion is inserted into the socket member central passageway, and the semi-flexible tongue element is automatically inserted into the central opening in the rigid frame element so that the tongue element elastic detent portion is engaged firmly with the rigid frame element central opening so as to prevent any undesired separation of the lampbase and socket members.

11. The lamp assembly of claim 10, wherein said elongated semiflexible tongue element has an elastic hinge portion located near the lampbase member;

and said biased detent portion is rectangular-shaped.

12. The lamp assembly of claim 11, wherein said tongue hinge portion and said detent elastic hinge portion together have sufficient outward bias to maintain the detent portion upper surface hooked below a transverse bar of the rigid frame element.

13. The lamp assembly of claim 12, wherein said detent portion upper end normally extends outwardly from the tongue element outer surface by a distance equal to at least about 50% of the detent portion thickness.

14. The lamp assembly of claim 10, wherein said rigid frame central opening is rectangular-shaped.

* * * * *